US009109340B1

(12) United States Patent
Linn, Jr. et al.

(10) Patent No.: US 9,109,340 B1
(45) Date of Patent: Aug. 18, 2015

(54) PILE-SUPPORTED CABLE-REINFORCED BUILDING

(71) Applicants: James D Linn, Jr., Brooksville, FL (US); Patricia C Linn, Brooksville, FL (US); Anderson C Stricklin, New Port Richie, FL (US); Jeff Varano, Weeki Wachee, FL (US)

(72) Inventors: James D Linn, Jr., Brooksville, FL (US); Patricia C Linn, Brooksville, FL (US); Anderson C Stricklin, New Port Richie, FL (US); Jeff Varano, Weeki Wachee, FL (US)

( * ) Notice: Subject to any disclaimer, the term of this patent is extended or adjusted under 35 U.S.C. 154(b) by 0 days.

(21) Appl. No.: 14/295,837

(22) Filed: Jun. 4, 2014

(51) Int. Cl.

| | |
|---|---|
| ***E02D 27/00*** | (2006.01) |
| ***E02D 5/22*** | (2006.01) |
| ***E02D 7/00*** | (2006.01) |
| ***E02D 27/01*** | (2006.01) |

(52) U.S. Cl.
CPC *E02D 5/223* (2013.01); *E02D 7/00* (2013.01); *E02D 27/01* (2013.01)

(58) Field of Classification Search
CPC ..... E04C 5/08; E04C 5/122; E04C 5/12; E04C 3/30; E02D 5/223; E02D 7/00; E02D 27/01; E02D 5/34; E02D 5/226; E02D 5/24; E02D 5/26; E04H 12/2292; E21D 15/52
USPC ..... 52/223.1, 223.4, 223.6, 223.13, 223.14, 52/293.1, 295, 296, 23, DIG. 11, 300, 301, 52/291; 405/239, 255, 244, 252
See application file for complete search history.

(56) References Cited

U.S. PATENT DOCUMENTS

| | | | | | |
|---|---|---|---|---|---|
| 1,324,076 | A * | 12/1919 | Smith | 52/301 |
| 1,547,175 | A * | 7/1925 | Lally | 52/301 |
| 2,664,977 | A * | 1/1954 | Starcevich | 52/301 |
| 3,606,716 | A * | 9/1971 | Norcross et al. | 52/301 |
| 5,586,838 | A * | 12/1996 | Walsh | 405/216 |
| 5,930,971 | A * | 8/1999 | Etheridge | 52/646 |
| 6,102,627 | A * | 8/2000 | Ueda et al. | 405/255 |
| 6,112,756 | A * | 9/2000 | Tseng | 135/123 |
| 6,314,693 | B1 | 11/2001 | Sanders | |
| 6,843,027 | B2 | 1/2005 | Gaddie et al. | |
| 2007/0186489 | A1 * | 8/2007 | Osbon et al. | 52/23 |
| 2013/0333314 | A1 * | 12/2013 | Ahern | 52/223.6 |

* cited by examiner

*Primary Examiner* — Brian D Mattei
(74) *Attorney, Agent, or Firm* — David Kiewit

(57) ABSTRACT

A building is reinforced by bonding a foundation slab to piles driven into the earth. Each pile has a cap attached to it at a height selected so that at least a portion of the cap can be captured within the foundation slab when it is poured. Before pouring, reinforcing cables are connected horizontally between selected attachment points on the pile caps and are set to a selected tension. Roof reinforcing cables may also be run from a pile cap upwardly through a wall, generally horizontally so as to capture roofing members, and down through another wall to be attached to a second pile cap.

6 Claims, 4 Drawing Sheets

PILE-SUPPORTED CABLE-REINFORCED BUILDING

BACKGROUND OF THE INVENTION

This document relates to apparatus and methods for reinforcing a building against the forces of windstorms and/or earth movement. More specifically, it relates to reinforcing pile-supported static structures.

BRIEF SUMMARY OF THE INVENTION

One aspect of the invention is that it provides apparatus for reinforcing a building by bonding a foundation slab to a plurality of piles driven into the earth. The piles are generally driven in to a depth of thirty five feet or until significant resistance is encountered. The apparatus comprises a separate cap for each pile, where each of the caps is attached to an associated pile at a selected height. This height is selected so that cable attachment portions of the caps can be captured within the foundation slab when it is poured. The reinforcing apparatus further comprises reinforcing cables, each of which is connected between a selected one of the attachment points on one of the pile caps and another selected attachment point on a different one of the pile caps.

In some embodiments, a pile cap comprises a flat plate portion having a plurality of throughholes, preferably about its periphery, and further having a tubular portion depending from the flat plate portion and arranged to slidably receive a selected pile therewithin. A clamping arrangement, such as one or more set screw(s), may be provided to lock the cap and pile together so that the flat plate portion of the cap is at the selected height.

In preferred embodiments, after the cables are connected between the caps, they are tensioned to a selected pre-stress before the slab is poured. Several approaches may be used to provide this tensioning. These comprise, without limit, providing a turnbuckle between portions of the cable assembly and drawing the cable to a selected tension during the attachment process and clamping it to one or more caps before releasing the drawing tension.

Another aspect of the invention is that it provides a method of making a reinforced building having a slab at a selected slab height. This method comprises the steps of: sinking a plurality of pilings into the earth at selected locations; attaching a separate pile cap to each of the pilings at a height chosen so that at least two cable attachment points on that pile cap are at the selected slab height; connecting each pile cap to at least one other pile cap by a respective cable; and then pouring the slab at the selected slab height so as to capture the selected attachment points and the connecting cables.

In preferred embodiments the piles are tubular and can be filled with grout. In some embodiments the piles are grouted prior to being capped. In other embodiments caps having grouting throughholes are used and the grout is injected through these holes after the piles have been capped and the cable assemblies have been connected.

Those skilled in the art will recognize that the foregoing broad summary description is not intended to list all of the features and advantages of the invention. Both the underlying ideas and the specific embodiments disclosed in the following Detailed Description may serve as a basis for alternate arrangements for carrying out the purposes of the present invention and such equivalent constructions are within the spirit and scope of the invention in its broadest form. Moreover, different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most, instances such definitions apply both to preceding and following uses of such defined words and phrases.

In particular, it should be understood that a 'cable assembly' may be a single portion of cable or may comprise two or more cable portions separated by other elements such as a tensioning mechanism. Thus, a cable assembly always comprises a selected length of cable and may also comprise, without limit, a clamping mechanism holding the cable assembly to an attachment point, a clamp holding one portion of a cable to another, or a tensioning mechanism.

Figure 1:
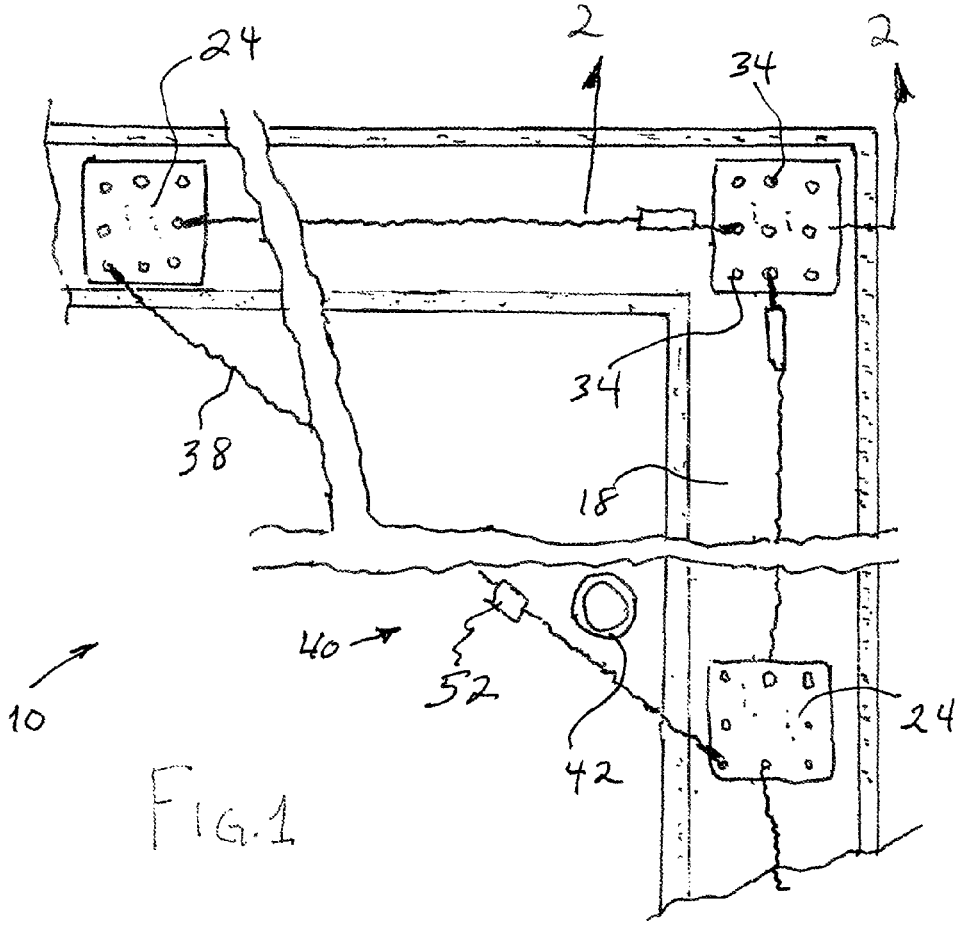
FIG. 1 is a plan view of a reinforcing arrangement of the invention, the view taken prior to pouring a concrete slab.
Figure 2:
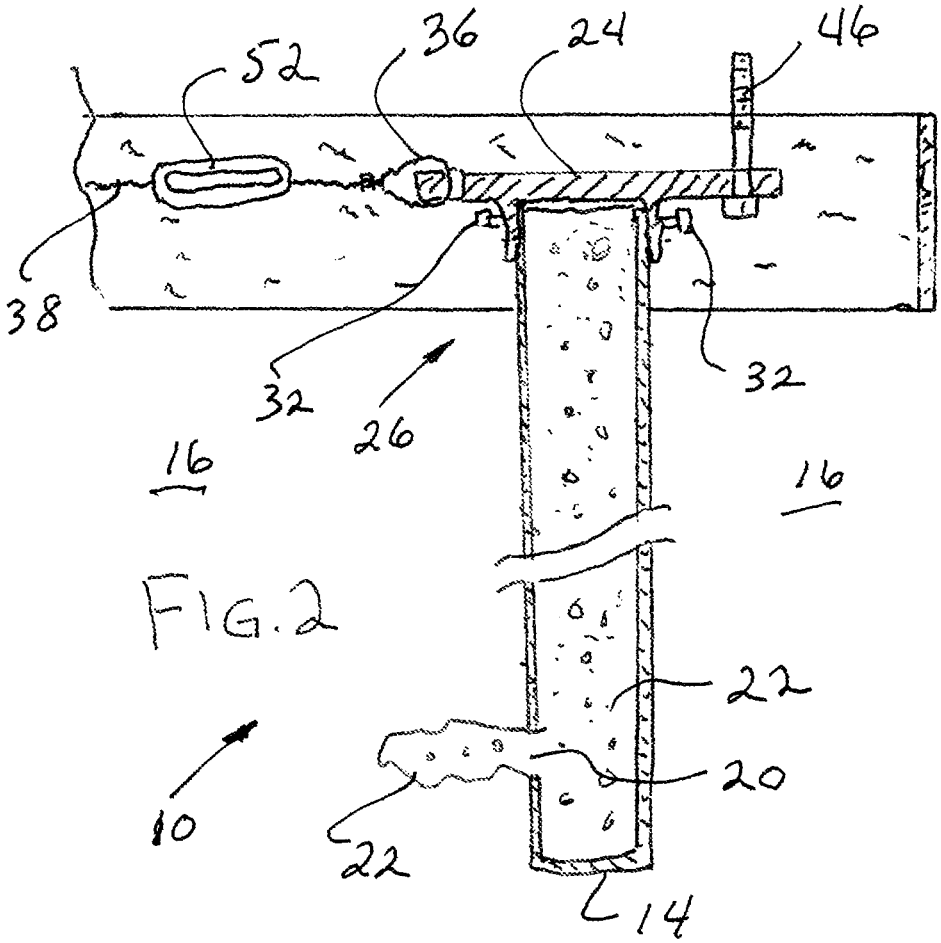
FIG. 2 is a vertical cross-section view, taken as indicated by the double-headed arrow 2-2 in FIG. 1, of a reinforcing arrangement of the invention.

Turning now to FIGS. 1 and 2 one finds two views of apparatus of the invention 10 installed at a building site prepared for pouring a foundation slab 12 that will be supported on piles 14 driven into the earth 16. The piles 14 may be located along a mid-line of a footer trench 18. In a preferred arrangement usable with loose or sandy soils, the piles are of the sort known as 'Franki piles' and have one or more holes 20 at their respective bottom ends through which grout 22 may be pumped to form laterally extended support portions.

Preferred embodiments arrange for the tops of the piles to be located somewhat below the mid-line of the slab height and for generally flat, plate-like, portions 24 of preferred pile caps 26 to be respectively attached to each pile so that at least some attachment points on the pile cap are at a height selected to position them at a mid-line of the slab 12 after the slab has been poured.

It will be recognized that pile caps 26 can be located at the desired height by driving the piles 14 into the earth until the desired height is obtained. More commonly, however, the desired pile-top height is obtained by leaving a somewhat taller pile portion sticking out of the ground and then cutting off the excess length.

In a preferred embodiment each pile cap 26 comprises a rectangular flat portion 24 having thickness preferably less than an associated slab thickness, the flat portion having a tubular portion 28 depending from it. The tubular portion preferably has a reinforcing web member 30 attached to it—e.g., by welding. The tubular portion 28 preferably has an internal diameter slightly greater than that of the associated pile 14 so the cap 26 can slide over the pile to the selected height before being clamped in place. In the preferred embodiment depicted in FIG. 3 the clamping operation is carried out with a set screw 32 threaded into the tubular portion 28 of the pile cap 26. The reader will recognize that there are many other approaches to securing the pile cap at the selected height and that these comprise, without limitation, multiple set screws 32 (as depicted in FIG. 2), mating threads on the pile and cap, and welding.

Attachment points 34 on a preferred pile cap 26 may comprise throughholes extending through a flat plate portion 24. As depicted in FIG. 1, a selected number, preferably eight, attachment throughholes 34 may be spaced out along the periphery of the plate. Reinforcing cable end portions can then be threaded through the attachment holes, bent back upon the cable body and clamped to form a connecting eyelet 36. If the pile cap height is properly selected so that a mid-line of the plate portion 24 is where the mid-line of the slab 12 will be when it is poured, this cable connection arrangement places the reinforcing cable 38 at the mid-line of the slab.

In most installations the pile caps 26 are interconnected not only by cable assemblies 40 running along the periphery of the slab, but also by cable assemblies 40 running across the slab in selected directions. Thus, in a preferred embodiment most pile caps are expected to be cable-connected to at least three other pile caps.

The provision of multiple attachment points on the pile cap allows a user to select points on pairs of pile caps so that a cable assembly 40 attached between the selected points avoids interfering with an obstacle such as plumbing 42, electrical or other components installed beneath and protruding upwards into or through the slab.

Figure 4:
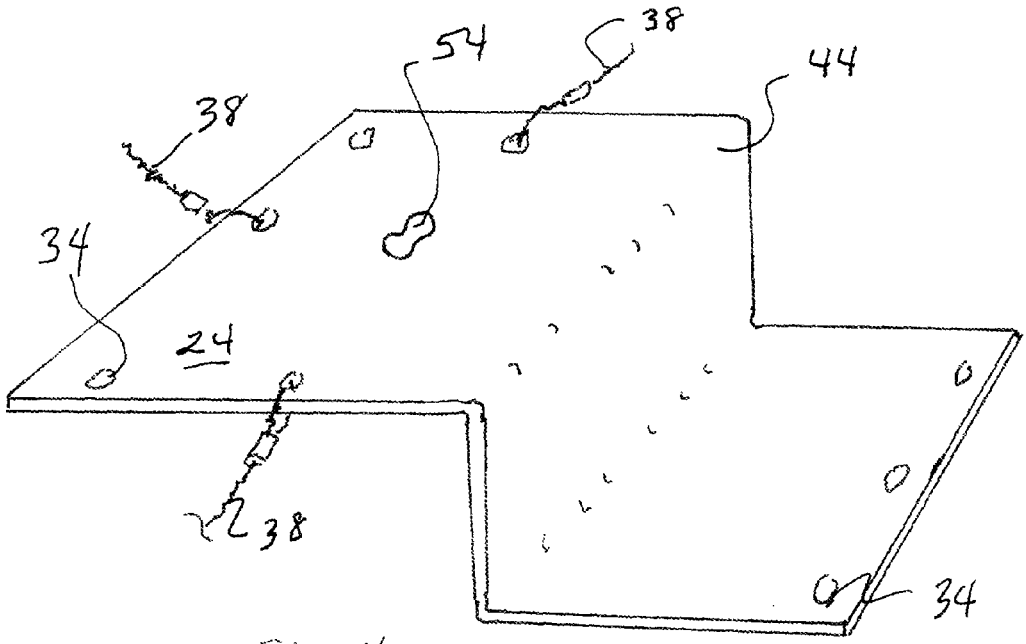
FIG. 4 is a perspective view of a step-down member providing cable reinforcement to slabs at two different heights.

A pile cap can also provide a step-down plate 44, as shown in FIG. 4. This preferably places a lower portion of the step-down plate at a mid-line of a lower slab, as is commonly used for a garage floor or a patio. In a preferred embodiment, the step-down plate is formed by making two bends in an extended cap top. Alternately, a separate step-down plate can be formed and bolted onto a cap.

Figure 5:
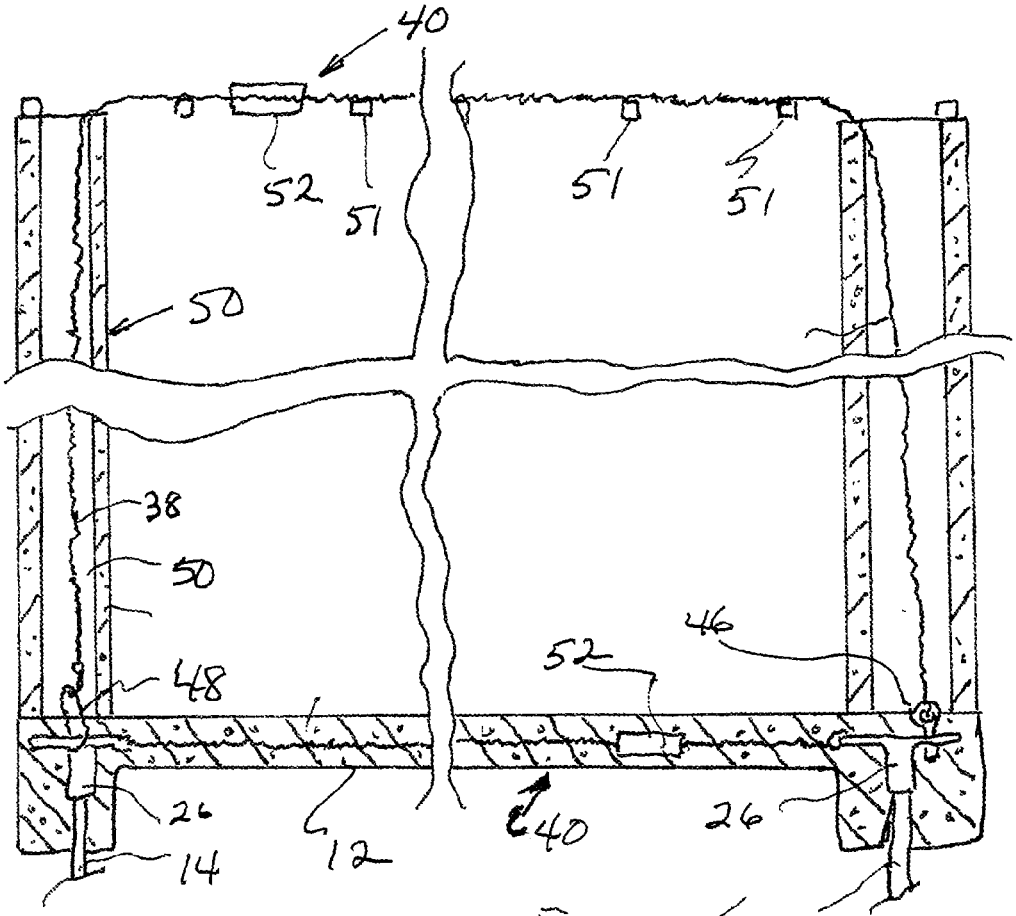
FIG. 5 is a cut-away view of a cable-reinforced roof structure.

The reader will recognize that an attachment point 34 may have many configurations other than a throughhole. Some of these result in the attachment point extending upwardly from a pile cap top 24. For example, in cases where the roof is to be tied down to the piles, one can provide an anchor bolt 46 extending above the slab. Thus, in a stick-built wall the anchor 46 may be a bolt attached to the pile cap 26 and extending upward through both the slab 12 and an aligned hole in a sill plate (not shown). Alternately, the anchor may be a loop of cable 48 attached to a throughhole attachment point and fished out of the slab before it fully sets. The loop, bolt or other attachment can be aligned, as shown in FIG. 5, within a vertical channel of a concrete-block wall 50. The roof tie-down cable can then be run up through the wall 50, across one or more roofing members 51 and down through another wall portion to be connected to a second anchor point.

Cable assemblies 40 extending horizontally between pile caps are generally placed under tension before the slab is poured. A preferred embodiment uses ⅜" diameter, multi-strand stainless steel cable. Cable assemblies used for roof tie-downs preferably use the same cable, but are generally loaded to a lower stress.

Cable assemblies 40 may comprise a tensioning device 52, such as a turnbuckle, to provide the desired load. In a preferred embodiment the tension in each cable is adjusted to the targeted value by turning a respective turnbuckle to an appropriate torque.

The reader will recognize that there are many arrangements for tensioning reinforcing cables. For example, one could attach one end of a cable to a pile cap, draw it to a desired tension and then clamp the other end of the cable to another pile cap while the cable was under load.

Figure 3:
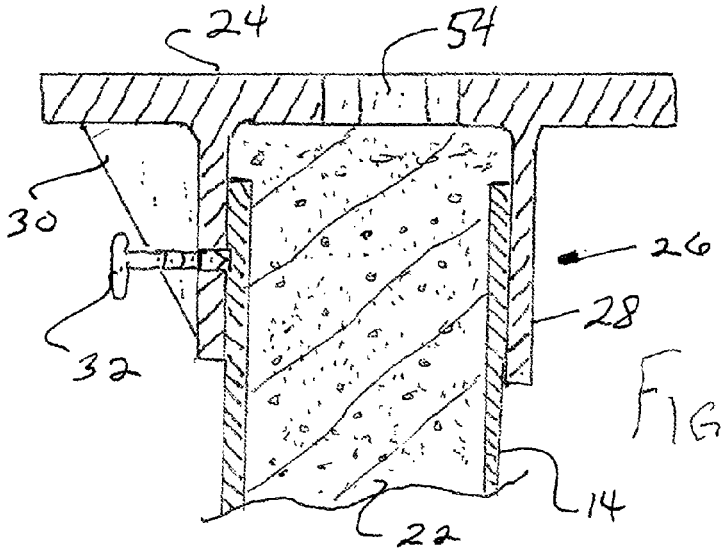
FIG. 3 is a detailed cross-sectional view depicting a pile cap of the invention attached to a pile.

Although the piles 14 may be empty tubes, in preferred embodiments they are filled with grout 22 that is preferably injected under sufficient pressure to force grout out through holes 20 near or at the bottom of the driven pile so as to form an expanded support base for the building. The grouting operation may be conducted at any of several stages in the overall construction process. For example, the piles may be grouted prior to capping, in which case the pile caps 26 can be made with no provision for attaching or inserting a grout nozzle. Caps 26 of this sort are depicted in FIGS. 1 and 2. In other embodiments each cap 26 comprises a grout injection throughhole 54 that preferably has a shape selected to allow a compatible grout nozzle to be inserted and locked in position, e.g., by a quarter-turn. Caps 26 of this sort are depicted in FIGS. 3 and 4.

Generally speaking, grouting before capping avoids the cost of forming a non-circular hole in the top surface 24 of the cap and allows for the use of a single cap design for an entire installation. Grouting after capping, on the other hand, allows for grouting immediately before the slab pour which may reduce the number of concrete deliveries to a job site.

Although the drawing shows preferred embodiments in which a pile 14 attaches to a central portion of a pile cap 26, the invention is not so limited. The depending tubular portion 28 of a cap, and an associated grouting hole 54 may be non-centrally located. FIG. 4 depicts an example of this in a step-down plate 44. In addition, the pile may be attached near a corner of the associated cap if the cap is to be used at the corner of a building.

Although the present invention has been described with respect to several preferred embodiments, many modifications and alterations can be made without departing from the invention. Accordingly, it is intended that all such modifications and alterations be considered as being within the spirit and scope of the invention as defined in the attached claims.

The invention claimed is:

1. An apparatus for reinforcing a static structure comprising a poured concrete foundation slab, the apparatus comprising:

a plurality of piles, each slidably received within a tubular portion of a respective pile cap, the respective pile cap comprising a respective flat portion having a thickness less than that of the slab, the respective pile cap attached to the associated pile at a height selected so that cable attachment points respectively disposed on the flat portions of the pile caps are captured within the concrete foundation slab; and a first plurality of reinforcing cable assemblies, each extending horizontally between a respective cable attachment point on a first respectively selected pile cap and a respective cable attachment point on a second respectively selected pile cap so that each cable assembly of the first plurality thereof is captured within the concrete foundation slab.

2. The apparatus of claim 1 wherein the cable attachment points on each of the pile caps comprise respective throughholes extending through the flat portion of the each of the pile caps.

3. The apparatus of claim 1 wherein each pile cap is connected to two or more other pile caps by respective cable assemblies.

4. The apparatus of claim 1 wherein the flat portion of each pile cap comprises a non-circular grouting throughhole.

5. An apparatus for reinforcing a poured concrete building slab having a mid-point at a selected slab height, the apparatus comprising, in combination:

a plurality of pilings sunk into the earth at selected locations, an upper portion of each of the pilings slidably received within a respective tubular portion of a respective pile cap;

wherein each pile cap is attached to the associated piling at a height chosen so that at least two of a respective plurality of cable attachment points associated with each pile cap are disposed at the selected slab height and are thereby captured within the building slab, wherein each pile cap is connected to at least one other pile cap by a respective cable assembly extending horizontally between respectively selected attachment points at the selected slab height on the respective pile caps so that each cable assembly is captured within the building slab.

6. The apparatus of claim 5 wherein the flat portion of each pile cap comprises a non-circular grouting throughhole.

* * * * *